US009759518B2

(12) United States Patent
Hidock et al.

(10) Patent No.: US 9,759,518 B2
(45) Date of Patent: Sep. 12, 2017

(54) REMOVABLE GUN SIGHT

(71) Applicants: Michael Hidock, San Diego, CA (US); Victor Saldamando, Ramona, CA (US)

(72) Inventors: Michael Hidock, San Diego, CA (US); Victor Saldamando, Ramona, CA (US)

( * ) Notice: Subject to any disclaimer, the term of this patent is extended or adjusted under 35 U.S.C. 154(b) by 0 days.

(21) Appl. No.: 15/006,376

(22) Filed: Jan. 26, 2016

(65) Prior Publication Data

US 2017/0211911 A1 Jul. 27, 2017

(51) Int. Cl.

| | |
|---|---|
| ***F41G 1/38*** | (2006.01) |
| ***F41G 1/02*** | (2006.01) |
| ***F41G 1/06*** | (2006.01) |
| ***F41G 11/00*** | (2006.01) |

(52) U.S. Cl.

CPC ..... *F41G 1/38* (2013.01); *F41G 1/02* (2013.01); *F41G 1/06* (2013.01); *F41G 11/001* (2013.01)

(58) Field of Classification Search

CPC ... F41G 1/00; F41G 1/02; F41G 1/033; F41G 1/06; F41G 1/08; F41G 1/10; F41G 1/12; F41G 1/16; F41G 1/22; F41G 1/38; F41G 1/383; F41G 1/46; F41G 1/473

USPC ..... 42/111, 119, 127, 135, 143, 144, 147, 42/148

See application file for complete search history.

(56) References Cited

U.S. PATENT DOCUMENTS 1,683,106 A * 9/1928 Schrank ..... F41G 1/473 42/111
2,295,791 A * 9/1942 Hornback ..... F41G 1/01 42/145
2,373,984 A * 4/1945 Trask ..... F41G 1/04 42/145
2,458,638 A * 1/1949 Pretzer ..... F41G 1/473 42/141
2,488,836 A * 11/1949 Sweetman ..... F41G 1/32 42/145
2,586,807 A * 2/1952 Fowler ..... F41G 1/12 42/141
2,610,405 A * 9/1952 Dickinson ..... F41G 1/02 42/143
2,795,048 A * 6/1957 Seymour ..... F41G 1/08 42/148
2,968,099 A * 1/1961 Peters, Jr. ..... F41G 1/383 359/600
2,972,190 A * 2/1961 Vissing ..... F41G 1/383 359/511
3,188,959 A * 6/1965 Wyser ..... F41G 1/48 102/483

(Continued)

*Primary Examiner* — Bret Hayes
(74) *Attorney, Agent, or Firm* — MU P.C.

(57) ABSTRACT

A set of temporary sights to fit on a scope has a first sight unit comprising a stretchable, resilient first ring adapted to be positioned on an end of the scope, a single, radially-protruding first sight member, a second sight unit comprising a stretchable, resilient second ring adapted to be positioned on an end of the scope, a radially-protruding sight comprising two uprights protruding from the ring, a top closure and a horizontal crosspiece connecting the uprights between the top closure and the second ring. The top closure, uprights and second ring may define a rectangular opening bisected by the horizontal crosspiece to define an upper and lower opening. The first sight unit may be adapted to mount over the front end of the sight, and the second sight unit is adapted to mount over the rear end of the sight.

10 Claims, 3 Drawing Sheets

(56) References Cited

U.S. PATENT DOCUMENTS

| | | | | | |
|---|---|---|---|---|---|
| 3,840,995 | A * | 10/1974 | Freiling | F41G 1/10 | 42/111 |
| 4,006,531 | A * | 2/1977 | Kwako | F41G 1/473 | 42/141 |
| 4,790,075 | A * | 12/1988 | Howard, Sr. | F41G 1/52 | 42/130 |
| 5,150,528 | A * | 9/1992 | Shire | G02B 23/16 | 220/375 |
| 6,416,189 | B1 * | 7/2002 | Watson | G02B 23/16 | 359/511 |
| 2015/0253107 | A1 * | 9/2015 | Hamilton | F41G 1/38 | 42/111 |
| 2016/0025454 | A1 * | 1/2016 | Meinert | F41G 1/387 | 42/71.01 |

* cited by examiner

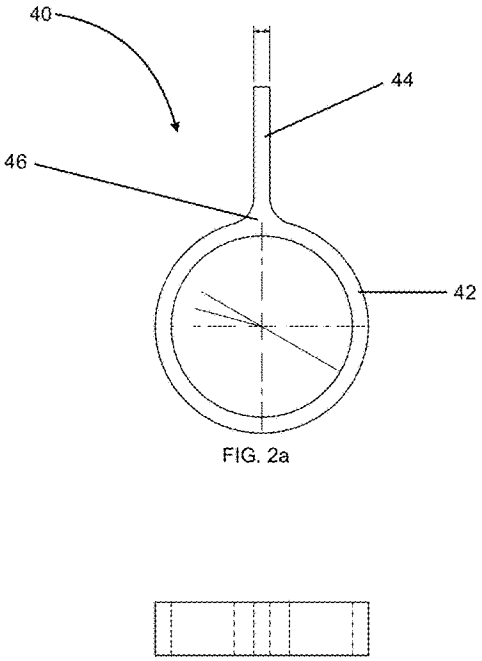
FIG. 2a
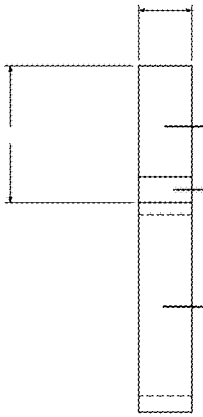
FIG. 2b
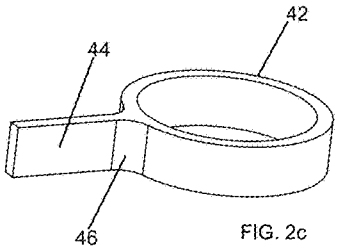
FIG. 2c
FIGURE 2

REMOVABLE GUN SIGHT

BACKGROUND OF THE INVENTION

1. Field of Invention

The present invention relates to the field of temporary and removable gun sights, in particular sights mounted on a scope or other over-barrel optics that makes open or iron sights impractical or unusable.

2. Description of Related Art

Rifle sights have been used for centuries to align the gun bore with a target so that the bullet or projectile may accurately strike the target. The sights generally have an axis parallel to the bore of the barrel, and are commonly mounted on top of the barrel, as reticle sights or a scope. Sights are typically adjustable by turret adjusters for range and windage and mounted higher than the barrel and oftentimes render existing sights unusable.

A scope allows the use of fine sights that are protected by the scope body, and frequently involves lenses to permit sighting accurately at a greater distance. However, a scope is difficult to use for quick sighting due to magnification, and requires the shooter to carefully align himself or herself behind the scope. This presents a drawback that is not easily remedied, as the scope is not easily removable once in place, and if removed, must be recalibrated once remounted on the barrel.

Based on the foregoing, there is a need in the art for removable or temporary sights that may be quickly applied to the front and rear of the scope and provide for accurate open sighting, and removed or collapsed when no longer needed or inoperable. Removable sights would preferably be open sights to provide for quick target acquisition.

SUMMARY OF THE INVENTION

A set of temporary sights to fit on a scope, each having a front and rear sight unit comprising a stretchable, resilient ring adapted to be positioned on both ends of the scope, each containing a single, radially-protruding Front sight member, and a radially protruding rear sight member. The rear sight member comprising a radially-protruding rear sight tower with three sight options which are square holes which can be trimmed to accommodate vertical sight alignment (and horizontal to some degree) and a front sight member comprising a single vertical post which can be trimmed to accommodate vertical sight alignment In an embodiment the front sight defines a vertical post and rear sight ring define a rectangular opening, and the horizontal crosspieces bisecting the openings to define three vertical sighting options. Each sight unit may be formed of a single piece of rubber containing both front and rear sight options that are separable from one another. The front sight unit may be adapted to be mounted over the front end of the sight, and the rear sight unit is adapted to be mounted over the rear end of the sight.

In one embodiment, a collar connects the front sight member to the first ring, and/or a collar connects the rear sight to the second ring.

A method of installing and using sights on a scope has the steps of stretching a front sight ring having a single protruding sight over one end of the scope, stretching a rear sight ring having two protruding uprights connected by a horizontal crosspiece over an opposite end of the scope, calibrating the sights by bore sighting, wherein a user removes a rifle bolt and views a target through a rifle bore, trimming the front sight unit so as to be level with the bottom of the target, and trimming the second sight unit to a certain width.

The front sight ring may be mounted on the front of the scope, and the rear sight ring may be mounted on the rear of the scope. The set may also have the step of selecting a higher and lower rear sight, wherein the higher rear sight is selected for scopes with high turret sight adjustment. In one embodiment, in sighting a target the horizontal crosspiece forms a cross with the single protruding sight.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

FIG. 2*a* is a front elevation view of the front sight, according to an embodiment of the present invention;

FIG. 2*b* is a side elevation view of the front sight, according to an embodiment of the present invention;

FIG. 2*c* is an isometric view of the front sight, according to an embodiment of the present invention.

DETAILED DESCRIPTION OF PREFERRED EMBODIMENTS

Figure 1:
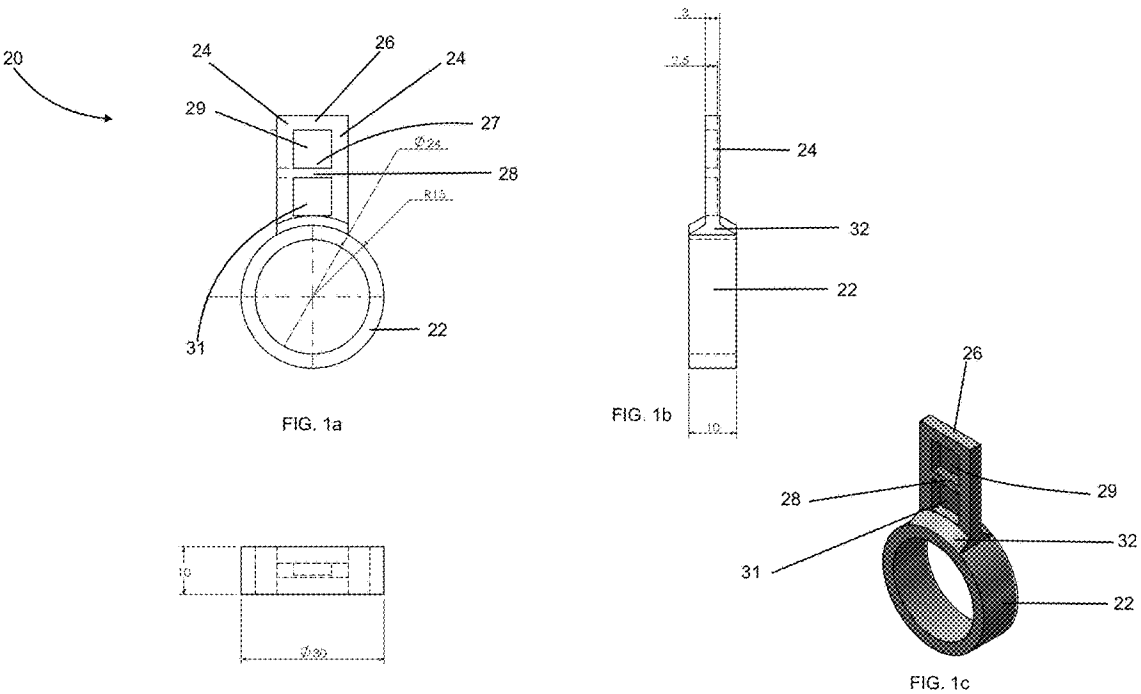
FIG. 1*a* is a front elevation view of the rear sight, according to an embodiment of the present invention.
FIG. 1*b* is a side elevation view of the rear sight, according to an embodiment of the present invention.
FIG. 1*c* is an isometric view of the rear sight, according to an embodiment of the present invention.
Figure 3:
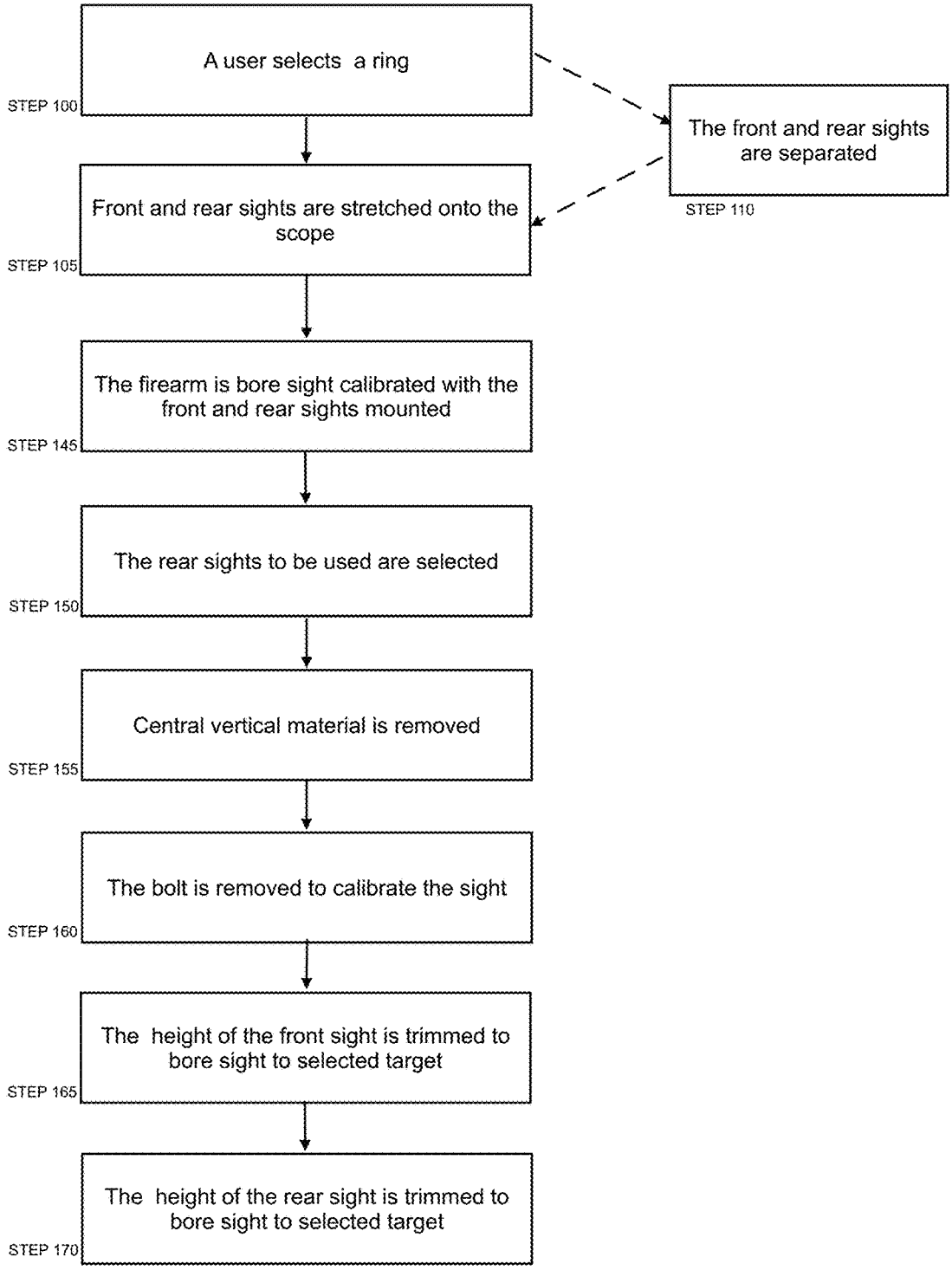
FIG. 3 is a flowchart showing the method of applying the sights, according to an embodiment of the present invention.

Preferred embodiments of the present invention and their advantages may be understood by referring to FIGS. 1*a*-3, wherein like reference numerals refer to like elements.

This device acts as a temporary adjustable gun sight for scoped rifles, to be used as an inexpensive and easily installed add-on device for rifles that have scope style optics as the primary sight device. A scope typically has a "bell" or expanded portion on front and/or rear, and the present invention is adapted for use with scopes with or without bells at its ends. The gun sight has front and rear sight units, wherein the front sight unit is mounted over the front bell area of the scope, and the rear sight unit is mounted over the rear bell area of the scope. The sight acts as a temporary but effective short-range (10 meters) open sight solution for use particularly during low light or short range fast-acquisition-necessary conditions, where a target cannot be acquired quickly enough with a scope to make an effective aimed shot. This sight will enable the user to use an "open sight" to quickly acquire and shoot at the intended target.

The temporary gun sight comprises a front sight unit 40 and a rear sight unit 20 for mounting on either end of a scope. With reference to FIGS. 1*a*-*c*, the rear sight unit 20 comprises a stretchable, resilient cylindrical retainer ring 22 for frictionally engaging and mounting on a rear scope bell, such that it is radially-protruding relative to the scope (not shown). In an embodiment, the radially-protruding rear sight 20 comprises two uprights 24, having a top closure 26 defining a rectangular opening 27 and a horizontal crosspiece 28 bisecting the opening 27, such that upper 29 and lower 31 openings are defined. In one embodiment, the sight protrudes approximately 25 mm from the outside surface of the cylinder (or an amount comparable to the diameter of the cylinder), and is 3 mm thick and 15 mm wide. In a preferred embodiment, the material is a silicone rubber or polyvinyl which has consistent stretch properties while retaining enough rigidity so the uprights may protrude radially counter to gravity. In an embodiment, the sight uprights 24 are thinner than the cylinder 22, wherein a collar 32 serves as an adapter between the thicker cylinder 22 and thinner uprights 24. In another embodiment, the upright 24 thickness is the same as the cylinder 22 thickness.

With reference to FIGS. 2*a-c*, the front sight unit 40 comprises a stretchable, resilient cylindrical retainer ring 42 for frictionally engaging and mounting on the front bell of a scope, with a single radially-protruding sight 44. The sights may be reversed and still operate as intended. In one embodiment, the actual operating unit has three apertures, which allows for adjustable rear sights to be trimmed to adjust to a particular need. Some scopes have high turret adjustments towers in the way that must be avoided by the sights when mounting.

In an example, the sight 44 protrudes approximately 25 mm from the outside surface of the cylinder, and is 3 mm thick and 10 mm wide, whereas the sight is 3 mm wide. In an embodiment, the sight thickness is the same as the cylinder thickness, and a collar 46 provides a transition between the cylinder 42 and sight 44. Given a horizontal crosspiece, the upper and lower openings each measure 8.0×8.0 mm. As the uprights 24 and the single sight 44 are made of a resilient material, if they are displaced to the side they will retain their shape once the displacing force is removed, and will protrude outwardly once again.

In an embodiment, the units are formed of silicone Rubber compression molded parts. In an embodiment, a package of the sight units may contain 3 silicone rubber rings with three diameter rings to accommodate different scope bell sizes, which contain both front and rear sight options and are height adjustable by trimming the sight. Each sight may be used as a front or rear sight. Ultimately this gives the user more sight ring versatility with regard to different scope diameters.

A method of installation and use is described. In order to install the device effectively on a scope that is mounted on the rifle, the user may follow the following steps. In step 100, the user first selects a ring, which will fit snugly over the front and rear section of the scope. Different sizes may be included in a package in order to facilitate a proper snug fit on the front and rear bells of the scope.

Once the ring location has been established, in step 105 the user stretches the selected rings onto the scope, paying attention to orienting the front sight blade or post option in the top position of the front bell of the scope, and orienting the rear sight on the top position of the rear scope bell. As there are two sight options on each sight, and in one embodiment the front and rear scopes are combined in one unit in the mold, in step 110 it will be necessary to separate the front and rear sights from one another prior to stretching over the scope.

The user must be careful not to cut into the area of the band itself and in step 115 may contact the cut area briefly with a heated metal device in order to seal the cut end from splitting or fraying. In step 120 the unused sight may be trimmed approx. 5 to 7 millimeters above the ring but the user should be careful not to jeopardize the integrity of the band portion of the ring.

In step 125, the user stretches the rear sight unit onto the scope, paying attention to placing the sight in the top position of the rear bell of the scope. As there are two sight options on each sight, in step 130 it is necessary to lightly trim the unwanted sight (in this example, the front sight option) from the bottom of the ring prior to stretching the ring over the scope. Again, the user should be careful to not cut into the area of the band itself and in step 135 should contact the cut area lightly with a heated metal device in order to seal the cut end. In step 140 the unused sight should be trimmed approx. 5 to 7 millimeters above the ring itself so as not to jeopardize the integrity of the band portion of the ring.

In step 145, bore sighting is calibrated. Once the front and rear sight units are mounted, in step 150 it is necessary to select which of the two rear sights should be used. For scopes with high turret sight adjustment towers, the higher rear sight is used by cutting the top off the sight, which exposes the open sight area. In step 155 the center vertical material is removed to the narrowest width. This can be cut wider later according to shooter preference. If the lower portion can be used, it may be cut along the top in the same way to remove the center vertical section.

In step 160 the bolt may be removed from the rifle and the user may view down the barrel interior at an object that is clearly discernible and approximately 8 to 12 meters away and centered in the bore. In step 165 the front sight height is trimmed so as to be level with the bottom of the object or target that is being viewed through the barrel, resulting in a zeroed open sight for the user. In step 170 the rear sight may be trimmed to a comfortable width as desired. The sights may be further calibrated by shooting a grouping at a target from a stable platform and adjusting the sights accordingly.

In use, once the sights are mounted and calibrated the shooter sights through the rear and front sights. The horizontal crosspiece 28 in the rear sight forms a cross with the single sight 44 of the front sight, to provide a clear indicator of the orientation of the firearm. The sights may be positioned vertically, and if removed, must be bore sighted again, but it is not necessary to remove the sights. When use of the sights is concluded, the sights may be removed and stored separately.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

We claim:

1. A set of temporary sights for a scope, the set comprising:

a. a first sight unit having
   i. a stretchable, resilient first ring adapted to be positioned on an end of a scope;
   ii. a single first sight member radially protruding from the first ring;

b. a second sight unit having
   i. a stretchable, resilient second ring adapted to be positioned on an end of the scope and
   ii. a second sight member radially protruding from the second ring and including:
      1. two uprights protruding from the second ring;
      2. a top closure connecting the uprights, and
      3. a horizontal crosspiece connecting the uprights between the top closure and the second ring.

2. The set of sights of claim 1, wherein the top closure, uprights and second ring define a rectangular opening, and the horizontal crosspiece bisects the opening to define an upper opening and a lower opening.

3. The set of sights of claim 1, wherein each sight unit is formed of a single piece of rubber.

4. The set of sights of claim 1, wherein the first sight unit is adapted to be mounted over a front end of the scope, and the second sight unit is adapted to be mounted over a rear end of the scope.

5. The set of sights of claim 1, further comprising a sloped transition connecting the first sight member to the first ring.

6. The set of sights of claim 1, further comprising a sloped transition connecting the each upright to the second ring.

7. A method of installing and using sights on a scope, comprising:

a. stretching a first sight ring having a single protruding sight over one end of a scope;

b. stretching a second sight ring having two protruding uprights connected by a horizontal crosspiece over an opposite end of the scope;

c. calibrating the sights by bore sighting, wherein a user removes a rifle bolt and views a target through a rifle bore;

d. trimming the first sight ring so as to be level with the bottom of the target;

e. trimming the second sight ring to a certain width.

8. The method of claim 7 wherein the first sight ring is mounted on the front of the scope, and the second sight ring is mounted on the rear of the scope.

9. The method of claim 7 further comprising selecting a rear sight from a higher and lower rear sight, wherein the higher rear sight is selected for scopes with high turret sight adjustment.

10. The method of claim 7 wherein in sighting a target the horizontal crosspiece forms a cross with the single protruding sight.

* * * * *